US005388181A

United States Patent [19]

Anderson et al.

[11] Patent Number: 5,388,181

[45] Date of Patent: Feb. 7, 1995

[54] DIGITAL AUDIO COMPRESSION SYSTEM

[76] Inventors: David J. Anderson, 2955 Lakehurst; Donghoon Lee, 2442 Stone Dr., both of, Ann Arbor, Mich. 48105; David L. Neuhoff, 2675 Newport Rd., Ann Arbor, Mich. 48103; Omar A. Nemri, 1324 McIntyre, Ann Arbor, Mich. 48105

[21] Appl. No.: 128,322

[22] Filed: Sep. 29, 1993

Related U.S. Application Data

[63] Continuation of Ser. No. 582,715, Sep. 13, 1990, abandoned, which is a continuation-in-part of Ser. No. 530,547, May 29, 1990, abandoned.

[51] Int. Cl.[6] ..... G10L 9/00

[52] U.S. Cl. ..... 395/212; 395/2; 395/2.1; 381/29

[58] Field of Search ..... 395/2, 2.38, 2.39, 2.1, 395/2.12

[56] References Cited

U.S. PATENT DOCUMENTS

| | | | |
|---|---|---|---|
| 3,982,070 | 9/1976 | Flanagan | 395/2 |
| 4,232,295 | 11/1980 | McConnell | 395/2 |
| 4,287,568 | 9/1981 | Lester | 395/2 |
| 4,300,040 | 11/1981 | Gould et al. | 395/2 |
| 4,330,689 | 5/1982 | Kang et al. | 395/2 |
| 4,528,643 | 7/1985 | Freeny, Jr. | 395/2 |
| 4,559,602 | 12/1985 | Bates, Jr. | 381/36 |
| 4,667,340 | 5/1987 | Arjmand et al. | 395/2 |
| 4,790,016 | 12/1988 | Mazor et al. | 395/2 |
| 4,896,362 | 1/1990 | Veldhuis et al. | 381/30 |
| 4,916,742 | 4/1990 | Kolesnikov et al. | 381/31 |
| 4,922,537 | 5/1990 | Frederiksen | 381/31 |
| 4,935,963 | 6/1990 | Jain | 381/31 |
| 4,949,383 | 8/1990 | Koh et al. | 381/31 |
| 4,953,214 | 8/1990 | Takeguchi et al. | 381/31 |
| 4,963,030 | 10/1990 | Makur | 381/31 |
| 4,965,830 | 10/1990 | Barham et al. | 381/31 |
| 5,021,971 | 6/1991 | Lindsay | 395/2 |
| 5,027,376 | 6/1991 | Friedman et al. | 381/31 |
| 5,040,217 | 8/1991 | Brandenburg et al. | 381/47 |
| 5,067,152 | 11/1991 | Kisor et al. | 381/31 |
| 5,068,899 | 11/1991 | Ellis et al. | 381/31 |
| 5,086,475 | 2/1992 | Kutaragi et al. | 381/36 |
| 5,091,944 | 2/1992 | Takahashi | 381/36 |
| 5,115,240 | 5/1992 | Fujiwara et al. | 381/37 |
| 5,197,087 | 3/1993 | Iwahashi et al. | 381/29 |
| 5,222,189 | 6/1993 | Fielder | 395/2.38 |

FOREIGN PATENT DOCUMENTS

| | | | |
|---|---|---|---|
| 2092354A | 8/1982 | United Kingdom | 395/2 |
| 2103000A | 2/1983 | United Kingdom | 395/2 |
| 2141907A | 1/1985 | United Kingdom | 395/2 |

OTHER PUBLICATIONS

Gray, Robert M., "Vector Quantization," *IEEE ASSP Magazine*, Apr. 1984, pp. 4–29.

Jayant, N. S., "High-Quality Coding of Telephone Speech and Wideband Audio," *IEEE Communications Magazine*, Jan. 1990, pp. 10–20.

*Primary Examiner*—Allen R. MacDonald
*Assistant Examiner*—Tariq Hafiz
*Attorney, Agent, or Firm*—Gifford, Krass, Groh, Sprinkle, Patmore, Anderson & Citkowski

[57] ABSTRACT

The digitally sampled data is split into a plurality of subbands each covering a different frequency range. The subbands are each individually expanded to normalize the energy in each band and the subbands are converted by FFT to the frequency domain and the magnitude and phase portions are processed by different techniques based on psychoacoustic principles. Magnitude data are processed by tree structured vector processing to develop code books for each subband which are unique to each song. Phase data are uniformly quantized with dynamic bit allocation used to increase resolution on transient passages.

33 Claims, 6 Drawing Sheets

DIGITAL AUDIO COMPRESSION SYSTEM

This is a continuation of copending application(s) Ser. No. 07/582,715 filed on Sep. 13, 1990, now abandoned, which is a continuation-in-part of U.S. patent application Ser. No. 530,547, filed May 29, 1990, now abandoned entitled "Digital Audio Compression System."

BACKGROUND AND SUMMARY OF THE INVENTION

The present invention relates generally to digital audio systems and more particularly to a data compression system for substantially increasing the playing time of a given storage medium without significant degradation of sound quality.

In applications where access to a large library of digital audio is desired, the main problem is in the extraordinary data volume required to store high quality music. To place this problem in perspective, the standard compact disc player transfers digital audio data at a rate of approximately 5.3 megabytes per minute for one stereo channel. If one were to store all compact disc data for a 3 minute stereo selection on a hard disk of a computer, the selection would occupy 31.8 megabytes, or more than a 30 megabyte hard drive can hold. Even using a large 750 megabyte disk drive only about 1 hour and 10 minutes of music could be stored. That is far too little for an evening's entertainment or for digital jukebox purposes.

While there have been some advances made in the field of data compression, present-day data compression techniques have not adequately focused on human auditory perception. For example, many data compression algorithms are intended for compressing telemetry and telecommunications data and speech. There has heretofore been no practical data compression technique for reducing the data volume to allow meaningful playing times on relatively simple devices while preserving audio quality of recorded music.

The present invention uses a combination of source coding theory and theory of human auditory perception to greatly reduce the storage requirements for digital audio. In the presently preferred embodiment the 5.3 megabyte per minute compact disc data rate has been reduced to 0.42 megabytes per minute per channel. This reduction in data rate is achieved by an encoding and decoding system in which the more costly components are used on the encoding side, to allow simple and inexpensive equipment to be used on the decoding side. More specifically, the system is designed to permit decoding with a processor with limited arithmetic precision, for example, 16 bit fixed-point arithmetic. The present invention is thus well suited for music distribution systems, video game systems, consumer audio systems, digital jukeboxes and computer-controlled video/audio systems.

In accordance with one principle of the invention, a wideband digital audio signal is processed by transforming it into the frequency domain comprising data capable of being represented as complex numbers. A magnitude portion and a phase portion are extracted from the frequency domain data, with different quantization processes being performed on the magnitude and phase portions. After the quantization processes, the magnitude and phase data are stored as digital data on a data storage medium. In the presently preferred embodiment the magnitude portion is quantized using a vector quantization technique while the phase portion is quantized using uniform scalar quantization. By treating the magnitude and phase separately, the invention permits different quantization rules to be applied to each. This allows the use of vector quantization of the magnitudes and scalar quantization of the phases.

In accordance with another principle of this invention, expansion via scaling of bands of magnitude coefficients to a common power level assures that the noise produced by their quantization will be essentially inaudible. Using this technique it is possible to achieve effects similar to a more complex process of dynamically choosing the rate of the quantizer (in bits per coefficient) on the basis of perceptual masking calculations.

In accordance with another principle of the invention, different vector quantizers are designed for different bands of magnitude coefficients. This use of a plurality of vector quantizers insures better performance, because the quantizer is matched to the band being encoded, e.g., more highly correlated vectors in the low frequency bands than in the high frequency bands. Moreover, the vector quantizers may have different rates (in bits per magnitude coefficient) reflecting the fact that the human auditory system is more sensitive to errors in some frequency bands than others.

In implementing the presently preferred embodiment, a vector quantization codebook is developed uniquely for the magnitudes of each segment (of approximately 3 minutes in length) of the audio selection being recorded. The unique codebook further includes portions which are unique to each of the frequency bands. On playback, the codebook is first transmitted to and loaded in the decoding equipment, whereupon the magnitude portions of the encoded digital audio may be quickly and efficiently decoded to restore the original magnitude portions. In accordance with another principle of this invention, the codebooks are two-stage and tree-structured so that excellent quantization characteristics are obtained with greatly reduced complexity.

Neural conduction time in the human auditory system is somewhat indeterminate and therefore the phase of higher frequencies is of less importance than the phase of lower frequencies. This means that while the phase at low frequencies must be quantized with a large number of bits, the phase at higher frequencies may be quantized with substantially fewer bits. The presently preferred embodiment uses a detailed understanding of human auditory perception to allocate the minimum number of bits to the quantization of each phase, with higher frequencies receiving less or even zero bits. Moreover, it uses pseudorandom phase dither to eliminate the audible effects of correlations in the quantized phase errors.

Transform coding, such as described in this invention, is susceptible to "pre-echo," which may be heard when intervals of silence are followed by a transient such as a drumbeat, unless corrective measures are taken. In accordance with a principle of this invention, pre-echo is greatly reduced or eliminated by dividing blocks into subblocks, detecting the occurrence of transients that would cause pre-echoes and individually expanding via scaling the subblocks of those blocks containing transients, in a manner that exploits temporal masking in human auditory perception. In accordance with another principle of this invention, pre-echo is reduced or eliminated by dynamically augmenting the bit allocation to the phase quantizers in blocks containing transients.

The entire system is designed with low cost decoding in mind. Specifically, several steps of the encoding process are tailored to minimize the potential for truncation errors when a low cost, limited precision fixed-point arithmetic is used in the decoder. One such principle is the expansion via scaling of each block before transforming.

For a more complete understanding of the invention, its objects and advantages, reference may be had to the following specification and to the accompanying drawings.

DESCRIPTION OF THE PREFERRED EMBODIMENT

Figure 1:
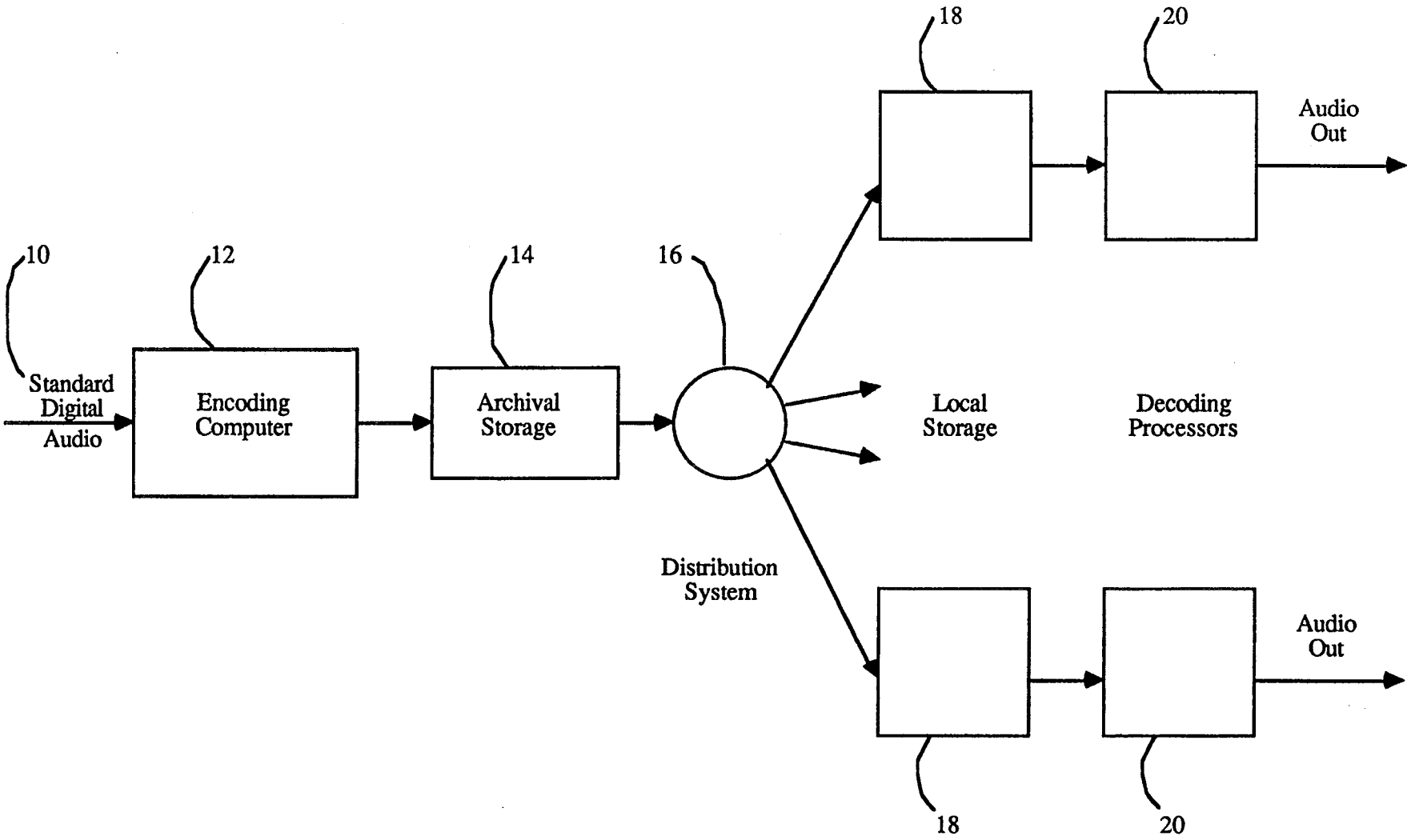
FIG. 1 is an overall block diagram of the digital audio encoding system of the invention, showing both encoding and decoding stations.

While the invention is applicable to a wide range of different applications, it will be described in the context of a music distribution system, such as might be found in a digital jukebox. Referring to FIG. 1, an example of a distribution system is illustrated. A source of a standard audio or digital audio is fed at 10 to the encoding computer 12 in which the encoding processes of the invention are performed. The encoding computer can be one of a variety of commercially available engineering work stations or high performance microcomputers. In the presently preferred embodiment, the encoding process is performed by software run on the encoding computer, although hardware implementations may be employed in high volume manufacture and distribution applications. Using present-day workstation computer technology, the encoding process proceeds in slower than real time, the encoded output comprising a highly compressed manifestation of the original digital audio input. As computer technology improves, it is anticipated that the encoding process may someday be performed nearly in real time, making broadcast applications more convenient.

The encoded digital audio is stored on an archival storage medium such as a hard disk system, CD-ROM, digital tape, or the like. The data stored on archival storage 14 are supplied through a distribution system 16 to a plurality of local storage media 18, which may be hard disk drives associated with individual jukebox players located at distributed locations, e.g., throughout the country. Virtually any digital data distribution system can be used for this purpose. For example, the individual jukeboxes can receive the latest selections by ground data link (telephone) or satellite link, via modem or other suitable equipment. Distribution can also be effected using floppy diskette, digital tape or other removable data storage media. Computer network systems can also be employed.

Associated with each local storage medium is a decoding processor 20, which transforms the locally stored compressed data into a high quality rendition of the original digital audio signal, which is then converted into analog form by a digital-to-analog convertor, amplified and played through the speaker system (not shown).

In essence, the encoding and decoding processes are complementary. The original digital audio signal is highly compressed during encoding, to save storage space and reduce the data transfer rate. This highly compressed data is decompressed upon decoding, to restore a high quality audio output. Although there is some signal quality degradation resulting from the encoding/decoding process, considerable emphasis is placed on retaining high musical quality by masking signal degradation either under loud sounds or next to loud sounds in the time or frequency domains. Using the invention, it is possible to provide at least FM broadcast quality stereo reproduction of a compact disc quality source in an economical package.

Although the presently preferred embodiment has been optimized to provide FM broadcast quality reproduction for digital jukebox applications, the principles of the invention can be used in systems which are adapted to give both higher and lower quality reproduction, depending on the audio requirements and amount of data compression required. Accordingly, the presently preferred implementation described herein should not be viewed as a limitation of the inventive principles of their broader aspects.

An advantage of the data compression achieved is that a useful number of selections can be locally stored on a fast access hard disk, making it possible to find and play a musical selection without the time delay associated with mechanical disk changers. These advantages also extend to the broadcast industry to permit the disk jockey to respond immediately to a listener's telephone request for an obscure hit record. Computer controlled video game systems might also use the invention to inject high quality audio program material at the appropriate time as play action is in progress. Home entertainment and car stereo systems might also benefit from the invention.

Figure 2:
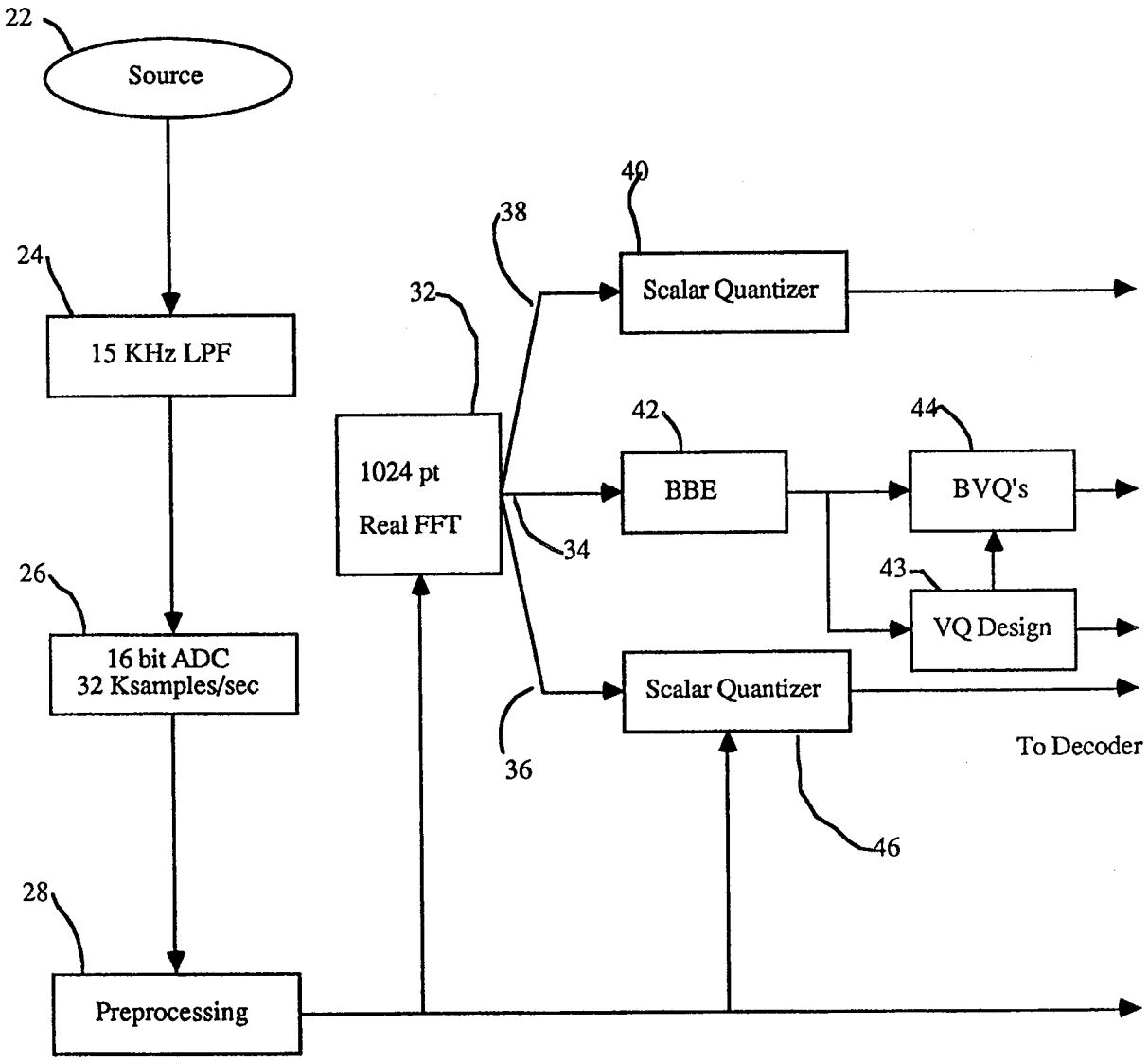
FIG. 2 is a block diagram of the presently preferred encoding system.

Turning now to FIG. 2, a description of the presently preferred encoding scheme will be described. As stated, the presently preferred encoder is implemented in software, although certain portions or all of the encoder might be implemented in hardware, if desired.

FILTERING AND SAMPLING

The audio source material, depicted at 22, is low pass filtered through a 15 kilohertz low pass filter 24 and converted into a digital audio signal by a 16 bit analog-to-digital convertor 26, sampling at 32 kilohertz (just above the Nyquist rate) and producing 32,000 digital audio samples per second. Therefore, the audio samples are 16 bit integers ranging from $-32{,}768$ to $+32{,}767$. In this illustration, an analog audio source is assumed. However, if desired, the digital data from a digital audio source could be used instead, in which case the filter and analog-to-digital convertor would not be needed, but if the digital audio is not sampled at 32 kilohertz, it must be converted to such using standard techniques.

PREPROCESSING

A. Segmenting

In the preprocessing block 28, the digital audio signal is first divided into segments of approximately 3 minutes. Each segment is separately encoded and decoded as described in the remainder of this document. The typical segment length (3 minutes) is a compromise. Shorter segments lead to higher quality audio reproductions at the expense of producing more bits.

B. Blocking

The segment is then divided into sequential, somewhat overlapping frames or blocks. In the presently preferred embodiment, each block consists of 1,024 audio samples (32 milliseconds) of which 64 are from the previous block. The blocks are then processed to minimize certain effects of transform coding such as pre-echo, post-echo, quantization errors and decoder truncation errors.

C. Subblocking, Transient Detection and Dynamic Time Domain Expansion of Subblocks The next preprocessing step is designed to reduce or eliminate pre-echo, and endemic problem in transform coding. The quantization process in transform coding (such as that to be described later) introduces errors that are inverse transformed at the decoder and spread evenly throughout the block. The power in the errors introduced in this way tends to be proportional to the average power of the audio signal in the block. The result is that if a block contains a drumbeat or other transient, the beginning of the block will consist of very small values and the end will consist of very large values. Overall, the average power of the block will be fairly large, and thus the errors introduced by the quantization process will be large relative to the initial quiet portion of the block. Thus, the reproduction of the block contains an initial splash of quantization errors that is audible as a "pre-echo" of (i.e., before) the drumbeat or other transient that follows.

To reduce or eliminate pre-echo, transients are detected in blocks and two processing steps are applied to blocks containing transients. The first, to be described here, is dynamic time domain expansion of subblocks. The second, to be described later in the section on phase quantization, is to allocate more bits to the quantization of phase in those blocks where transients are detected.

To detect transients, each block is subdivided into 8 subblocks of 128 samples each. The average power, or simply power, in each subblock is then calculated. (The average power in a block is the sum of the square of the components of the block divided by the number of components in the block. ) If the ratio of the average power in a subblock to the average power in the previous subblock is greater than a certain threshold, a flag is set to indicate that a transient has been detected in the block and dynamic time domain expansion (to be described shortly) is undertaken. As the quantization process used in transform coding (such as that to be described later) introduces much more errors in quantizing high frequency audio signals than low frequency audio signals (because the ear is insensitive to high frequency errors), it is high frequency transients that contribute the most to pre-echo. Thus in the presently preferred embodiment, the block is high-pass filtered before transient detection. If $x_{2n-1}$, $x_{2n}$ denotes the nth pair of samples in a block, then the high pass filter in the presently preferred embodiment produces $$y_{2n-1}=x_{2n-1}-a_n$$

$$y_{2n}=x_{2n}-a_n$$

in response to $x_{2n-1}$ and $x_{2n}$, where $$a_n=(x_{2n-1}+x_{2n}+x_{2n+1}+x_{2n+2})/4$$

is the average of $x_{2n-1}$, $x_{2n}$ and the two subsequent samples. The ratio threshold is set at 2. Finally, to avoid spurious detection of transients, a transient is detected only if the RMS power in the subblock (i.e., the square root of the average power) is greater than some specified threshold, presently set at 50 (on the scale of −32,768 to +32,767).

When a transient is detected in a block, the (unfiltered) subblocks occurring before the transient are expanded by scaling with various expansion factors. Subblocks occurring well before the transient are scaled by larger factors than those occurring just before the transient. The subblock containing the transient and subsequent subblocks are not scaled. The transition from large expansion factors to smaller occurs gradually or in a stepwise diminishing fashion. The reason for the diminishing set of expansion factors is the backward masking phenomenon in human auditory perception, wherein errors occurring just before a transient are less noticeable than those occurring well before the transient. The small expansion factor applied to the subblocks just before the transient permits more quantization noise (introduced in subsequent steps) than the larger expansion factor applied to segments well before the transient.

In the presently preferred embodiment, if a transient is detected in the nth subblock, $1 \leqq n \leqq 8$, (that is, the ratio of the power in the nth filtered subblock to that of the previous filtered subblock is sufficiently large and its RMS power is sufficiently large), then the ratio R of the power in the last 9-n subblocks (unfiltered) to that of the first n−1 subblocks (unfiltered) is computed. The expansion factors g1, . . . ,gn−1 for the first n−1 subblocks are as follows:

If $R>13$, then $g_i=(R+1)/i$, for $i=1, \ldots, n-1$.
If $1<R<13$, then $g_i=R+1$, for $i=, \ldots, n-1$.
If $R<2$, then $g_i=1$.

Note that although no expansion is actually done in the last case, the transient flag is still set and used to increase the bit allocation for phase quantization. Note further that the expansion factors are between 1 and 2. Finally, note that the high pass filter is used only to detect transients and is not part of the final processing of the data; i.e., it is the unfiltered data that is expanded. To reduce the possibility of truncation errors in the fixed-point arithmetic of the decoder, in the presently preferred embodiment, R is rounded to a number whose inverse can be exactly used by the decoder as a multiplication factor. The factor R, the transient flag and the index n are all recorded as part of the encoded digital data. In the presently preferred embodiment 12 bits are used to describe these. In segments encoded to date, no more than 1/6 of the blocks contained transients, meaning that at most 0.002 bits per sample were required for these parameters.

Although not included in the presently preferred embodiment, the same approach can be used to reduce post-echo. In this case we would detect transients from loud to quiet, as in the end of a drumbeat. In blocks where a loud to quiet transient were present, scaling of subblocks after the transient would take place with those subblocks farthest from the transient being scaled up more than those closer to the transient.

The dynamic time domain expansion described here is useful for any block quantization process (e.g., transform coding) that would otherwise introduce pre-echo.

D. Time Domain Expansion of Blocks

The next preprocessing step is time domain expansion on a block-by-block basis, wherein each block is scaled so its maximum equals a specified value. The specified maximum value is chosen to be the largest value that the decoder can represent or 70.7% of this value if two stereo channels are to be simultaneously decoded in the manner described later. The purpose of this time domain expansion is to amplify quiet blocks so that truncation errors due to decoding, especially due to inverse Fourier transforming, with limited precision fixed-point arithmetic will be small in comparison. It also reduces, in quiet blocks, the effects of quantization errors introduced in subsequent steps. The expansion factor for each block is recorded as part of the encoded digital data. In the presently preferred embodiment the expansion factors are limited to being powers of 2 so that the inverse expansion at the decoder can be done rapidly and exactly with fixed-point arithmetic. The result is that in the presently preferred embodiment 0.004 bits/-sample are used for this purpose.

This time domain expansion is useful for any digital audio encoding process that divides the audio signal into blocks.

E. Windowing

The window is a square root Hanning window in the 64 sample overlap area at the beginning of the block and also at the end of the block; i.e., the window allows 1/16th of its size for overlap add. The Hanning window gradually diminishes the amplitude of one block in the overlap while increasing the amplitude of the next block, blending the two together to avoid transients due to different coding parameters on either side of the overlap. A square root Hanning window is also applied at the decoder as well. To eliminate the possibility of truncation errors when decoding with fixed-point arithmetic, in the presently preferred embodiment, the window values are rounded to values exactly representable by fixed-point arithmetic.

TRANSFORMING BLOCKS

After preprocessing, each data block or frame is transformed with an N point Fast Fourier Transform (FFT) 32 into a set of N complex numbers, called the transformed block, where N matches the size of blocks ($N=1{,}024$ in the presently preferred embodiment). In effect, the FFT converts these data blocks from the time domain to the frequency domain, with the ith complex number representing the frequency component at frequency $f_S(i-1)/N$, $1 \leqq i \leqq N$, where $f_S$ denotes the sampling frequency (32 kilo-hertz in the presently preferred embodiment). Any suitable computer implemented Fast Fourier Transform algorithm can be used for this purpose. Each complex number in the transformed block is then converted into 2 real numbers, a magnitude and phase. According to Fourier transform theory, the last N/2 magnitudes and the last N/2 phases are redundant, so the first N/2 magnitudes and the first N/2 phases will be referred to as the magnitude block and the phase block, respectively. Throughout the remainder it will be assumed for concreteness that $N=1{,}024$.

In accordance with the invention, the magnitude and phase blocks are handled by different processes. Accordingly, processing of the magnitude portion proceeds along branch 34 and the phase portion along branch 36. The DC and Nyquist points are also separated and quantized along branch 38 using a 16 bit uniform scalar quantizer

OVERVIEW OF QUANTIZING MAGNITUDES AND PHASES

After the magnitude and phase portions are separated, the magnitude block is divided into subblocks called bands and each band is expanded via scaling. This process, which is referred to as band-by-band expansion (BBE) is depicted at BBE block 42. This is done for all blocks of the entire segment. The expansion coefficients for each band of each block are recorded as part of the encoded digital data.

For each band, a vector quantization codebook is designed. Such codebooks may be designed to work for any segment of audio, or as in the preferred embodiment described here, they may be designed for the specific audio segment being encoded. In this case, the codebook for a given band is designed by training on the sequence formed by concatenating the elements of that band from each magnitude block of the digital audio segment being encoded (approximately 3 minutes in the preferred embodiment), and the codebooks themselves are recorded as part of the encoded digital data. The vector quantizer design block is pictured at 43.

After the band codebooks have been designed, the magnitude blocks are processed sequentially. Each band of a given magnitude block is further divided into vectors (with vector lengths equal to the dimension of the codebook for that band), which are then assigned an index from the codebook for that band. The vector quantizer block is depicted at 44. The index for each vector of each band and block are recorded as part of the encoded digital data.

Each term in a phase block is quantized with a uniform scalar quantizer 46. The indices produced by this quantization process are recorded as part of the encoded digital data. The step size of the quantizer depends on the frequency corresponding to the given phase term, as described later. In addition, pseudorandom phase dither is added to each phase, as described later. The bits produced by the phase quantizers are included as part of the encoded digital data.

The details of the magnitude and phase quantization are described below.

MAGNITUDE QUANTIZATION

A. Band-By-Band Expansion (BBE)

Band-by-band expansion is used to reduce the audibility of the errors introduced by vector quantization through exploitation of the spectral masking properties of the human ear. The background is the following. When applied to a block of magnitudes, a typical quantization process (for example, the vector quantization process described later) spread quantization errors evenly throughout the block. However, the ear is less sensitive to errors in magnitudes corresponding to frequencies in the neighborhood of which the magnitudes are generally large. Indeed, at any frequency there is an auditory "critical band" surrounding that frequency that errors at this frequency are inaudible if the error power within the critical band is a sufficiently small fraction of the power in the magnitudes within the critical band. The width of these critical bands has been found to be proportional to the logarithm of the center frequency. This critical band theory indicates that, unless corrective measures are taken, the quantization noise will be audible in bands where the magnitudes are small.

Band-by-band expansion is a very simple and effective way to take corrective measures, thereby exploiting the spectral masking effect. In band-by-band expansion each magnitude block is divided into subblocks, called bands, of adjacent terms; each band is then expanded via scaling to some common power before quantizing. The result is that the quantization errors are equally inaudible in all bands. More specifically, each band is expanded as much as possible, with the constraints that all bands have the same power after expansion and that no expanded magnitude term exceed the maximum value representable at the decoder. In addition, the expansion factors are rounded to numbers whose inverse can be exactly used by the decoder as multiplication factors. The expansion factors are recorded as part of the digital data.

It is important to choose the expansion band widths appropriately. Generally narrower bands give a better spectral masking effect but more bits are required to describe the expansion factors. However, the critical band theory indicates that there is no need to make the bands narrower than the critical bands. Indeed it was found that 12 bands each roughly twice the width of the critical band at its frequency lead to the most efficient implementation. See Table I for the preferred sets of bands. For example, band 9 contains the 40 magnitudes from 100th to the 139th which correspond to frequencies from 3,125 hz to 4,343.75 hz. The encoding of the expansion factors for these bands requires 0.05 bits/sample.

The band-by-band expansion just described is useful not only when processing the magnitudes from a Fourier transform but also when processing the transform coefficients produced by any transform whose coefficients are interpretable as corresponding to frequencies, for example, the discrete cosine transformation.

TABLE I

A list of the subband lower edges and number of coefficients that fall with each as used in this coding scheme.

| Band No. | No. of Coefficients | Lower Edge of Band in hz |
|---|---|---|
| 1 | 3 | 31.25 |
| 2 | 8 | 125 |
| 3 | 8 | 375 |
| 4 | 8 | 625 |
| 5 | 12 | 875 |
| 6 | 16 | 1250 |
| 7 | 20 | 1750 |
| 8 | 24 | 2375 |
| 9 | 40 | 3125 |
| 10 | 64 | 4375 |
| 11 | 100 | 6375 |
| 12 | 208 | 9500 |

VECTOR QUANTIZATION OF EXPANDED MAGNITUDES

After the magnitudes are band-by-band expanded, the expanded data is vector quantized using a distinct codebook for each band, and preferably each codebook is uniquely designed for the audio segment. Codebook design is discussed more fully later.

Using a separate quantizer for each band, vector quantization performance is enhanced, because the statistical characteristics of the magnitude vectors within a given band are quite similar, but may be quite different than the characteristics of other bands. For example, lower frequency bands are more correlated than higher frequency bands.

Another advantage of designing a separate quantizer for each band is that they may have different encoding rates (in bits/coefficient) to reflect perceptual criteria for preferentially doing finer quantization of certain bands than others, thereby reducing the total rate while maintaining high quality.

Note that the bands adopted for vector quantization need not be the same as the bands adopted for band-by-band expansion. The more narrow the band (and, consequently, the more bands), the better the performance of the vector quantizers. However, the decoder becomes more complex, and if the codebooks are individually tailored to the segment, more bits are needed to describe the codebooks. Since the statistics of the vectors within a given band of the band-by-band expansion were found to be similar, in the preferred embodiment, these bands are used for the vector quantization as well.

A tree-structured vector quantizer (TSVQ) is preferred for each band, as this gives excellent performance with greatly reduced complexity (reduced design time, reduced quantization time and reduced decoder storage). Thus the present implementation has 12 TSVQs. TSVQ is described in more detail later.

The rate of each TSVQ (in bits per magnitude coefficient) is controlled by varying the "depth" of the tree. Specifically, the rate of a TSVQ is the depth divided by the block length. Rate selection for the quantizers will be explained later. To keep the size of the codebooks small, two-stage, tree-structured vector quantization (TSVQ) is employed wherever the desired rate exceeds 2 bits per magnitude coefficient. The codebook dimension (i.e., the vector length) is fixed at 4, with the exception of the first band having a dimension of 3 since there are only 3 coefficients.

There are two conflicting factors affecting the selection of the dimension of the vector quantizers. On one hand, the larger the dimension, the better vector quantization performs. On the other hand, for a given encoding rate the codebooks size increases exponentially with dimension, thus dramatically increasing the complexity of encoding and decoding (codebooks design time, quantization time and decoder storage). For instance, at dimension 8 and rate 2, one codebook is 1 megabyte. For an encoder using 12 separate bands, a vector length 8 and rate 2 implementation would require 12 megabytes of codebooks, which is considered impractically large for this application.

Consequently, codebook dimension is selected small enough so that the codebooks will be of acceptable size but large enough so that vector quantization is efficient. From simulation studies it was learned that codebook dimension 4 provided acceptable quantizer performance. Furthermore, at rate 2 the codebook size is 2K bytes, which is reasonable.

The rate of each vector quantizer (i.e., the tree depth for each TSVQ) was selected for the presently preferred embodiment based on simulation studies under the broad guideline that at higher frequencies, lower rates can be used. That is to say, at higher frequencies, more noise can be tolerated. This is based on psychoacoustic findings. Table II sets forth the presently preferred tree depths. Additionally, since the audio signal is filtered to 15 kilohertz, the last 32 magnitudes are negligible and are not quantized at all. (The decoder assumes them to be zero). With these rate allocations, the code word indices require a total of 0.96 bits/sample and the description of the codebooks requires 0.03 bits/sample, assuming a 3 minute segment.

TABLE II

Dimensions, tree depths and rate allocations for magnitude TSVQs as used in this code.

| Band No. | VQ Dimension | First Stage Depth | Second Stage Depth | Rate Allocation (Bits/Coefficient) |
|---|---|---|---|---|
| 1 | 3 | 6 | 3 | 3 |
| 2–9 | 4 | 8 | 4 | 3 |
| 10–11 | 4 | 8 | — | 2 |
| 12 | 4 | 4 | — | 1 |

Figure 3:
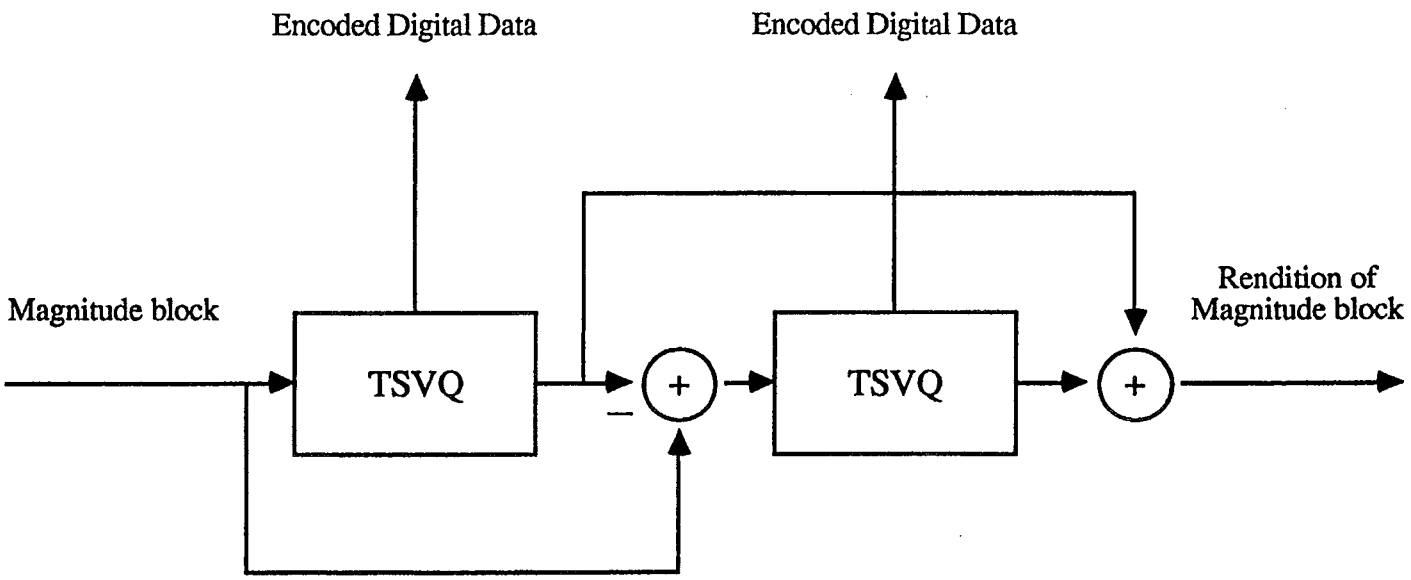
FIG. 3 is a block diagram of a two-stage, tree-structured vector quantizer.

The values shown in Table II are a set that yields acceptable performance. However, these values may be changed, if desired, to suit particular audio requirements. Moreover, after auditioning the encoded and decoded segment it is possible to change the parameters to achieve certain rate or quality goals. As shown in Table II, two-stage TSVQ is employed. The primary reason is to reduce the size of codebooks. FIG. 3 shows a block diagram of a two-stage TSVQ.

A secondary advantage of the band-by-band expansion is that it makes the magnitude vectors in a given band more homogeneous, thus making it possible for the codebook design algorithm, described later, to produce a better codebook for the given band.

The above-described encoding process, which employs two-stage, tree-structured vector quantization, is based on codebook which is uniquely designed for each segment. This codebook, in turn, comprises a set of codebooks, one uniquely designed for each of the 12 subbands. This approach is presently preferred, since it gives excellent performance and since the codebooks can be downloaded to the playback equipment relatively quickly, prior to the music playback. In the alternative, a universal codebook could be developed (i.e., one for a segment, or even one for all segments), although it is anticipated that such a codebook would be larger than a segment-specific codebook and this might require greater memory capacity in the decoding and playback equipment. It is also possible to use a universal codebook with a mask unique to a particular segment to allow only the necessary portions of the universal codebook to be uploaded prior to music playback.

CODEBOOK DESIGN

The presently preferred codebook design process is performed using the data (or representative sampling of the data) of the band and segment for which the codebook is being developed. The codebook development process is implemented by employing the techniques generally described in *IEEE Transaction on Information Theory*, "Speech Coding Based Upon Vector Quantization, " by A. Buzo et al., Vol. 28, pp 562–574, October 1980. See also *IEEE ASSP Magazine*, "Vector Quantization, " by R. M. Gray, Vol 1, pp 4–29, April 1984. We have significantly enhanced the algorithms described in the foregoing references which will be described below. The enhancements greatly speed up the codebook development process. Before discussing these enhancements, a brief description of the general principals of tree-structured vector quantization (TSVQ) will be given.

TSVQ, like other forms of vector quantization, is a method of partitioning the input vector space into N, a power of 2, disjoint subsets and representing each subset with a code vector and an index. The partitioning works in a hierarchial way following a certain binary tree structure.

A binary tree of depth d is a data structure consisting of one "root node," and $2^d-2$ "internal nodes" and $2^d$ "terminal nodes." The root node and each internal node have two other nodes (either internal or terminal) as its "children." The children of the root node are said to be at depth 1, the children of these are at depth 2, and so on. Consequently, there are $2^e$nodes at depth e. The $2^d$ children of the nodes at depth $d-1$ are the terminal nodes.

In a TSVQ of dimension k and depth d, there is a binary tree of depth d, with one k-dimensional testvector associated with the root node and each internal node, and with a codevector associated with each terminal node. Designing a TSVQ consists of choosing the testvectors and codevectors. The set of codevectors constitutes the codebook of the TSVQ. Before describing the method for designing the codebook and our enhancements thereto, we describe how the encoding via partitioning is accomplished with a given set of testvectors and codevectors.

Given a k-dimensional input data vector x to be quantized, the Euclidean distance is computed from x to each of the testvectors associated with the two children of the root node. Then the children at depth 2 of which ever child at depth 1 give smaller distance are each compared to the data vector x to find the closest. In a similar manner, at each depth a pair of children are compared to x and after a total of $d-1$ such comparisons, a testvector at depth $d-1$ is found. Then x is compared to the two codevectors that are children of this testvector and the closest of these becomes the codevector that represents the data vector. Its index among the set of codevectors becomes part of the encoded digital data. The decoder then uses the index to reproduce the codevector as a rendition of the input data vector.

A principal advantage of TSVQ is that this partitioning method requires substantially fewer arithmetic operations than direct searching of the codebook for the closest codevector. Although the TSVQ method does not necessarily find the closest codevector in the codebook, it has been found that it generally finds a good one. Note that the testvectors are needed for encoding only, whereas the codevectors are needed for both encoding and decoding, and accordingly, in the preferred embodiment the codevectors (codebook) are encoded as part of the digital data.

Designing a TSVQ consists of selecting the testvectors and codevectors. As with any vector quantization process, the success of TSVQ depends on the quality of this design. For the invention described here, a very important advantage of TSVQ is that good TSVQ codebooks can be designed much more rapidly than otherwise unstructured codebooks. (This is important because designing the codebooks is part of the process of encoding a segment.) The design procedure and our enhancements will now be described.

The design is based on a training set, consisting of a sequence of k-dimensional training vectors from the data to be encoded. (As mentioned earlier, in the preferred embodiment, one codebook is designed for each band of each segment, so the training set is formed by concatenating the elements of that band from each magnitude block of the digital audio segment being encoded.)

The TSVQ algorithm designs the testvectors one depth at a time, starting at the root node. The testvector associated with the root node is the "centroid" of the entire training set, where the centroid c of a set $S=(x_1, \ldots x_m)$ is the vector average of the $x_i$s; i.e., $$\frac{1}{m}\sum_{i=1}^{m} x_i.$$

Next to find the child testvectors of c (at depth 1), one begins by selecting an initial candidate c1 and c2, for each. Usually these are c times $(1-\epsilon)$ and c times $(1-\epsilon)$ where $\epsilon$ is a small number, say 0.0005. Then the training set is partitioned into two subsets, according to which of the candidate testvectors is closest. The candidate testvectors are then replaced by the centroids of these subsets, forming new candidate testvectors $c'_1$ and $c'_2$. Specifically $c_1$ and $c_2$ are replaced respectively, by (Equation 1)

$$c'_1 = \frac{1}{m_1}\sum_{\substack{it\ x_1 \text{ is closer} \\ \text{to } c_1 \text{ than } c_2}} x_i$$

(Equation 2)

$$c'_2 = \frac{1}{m_2}\sum_{\substack{it\ x_1 \text{ is closer} \\ \text{to } c_1 \text{ than } c_2}} x_i$$

$$c_2 = \frac{1}{m_2}\sum x_i$$

where $m_1$ is the number of testvectors closer to $c_1$ than $c_2$ and $m_2$ is the number of testvectors closer to $c_2$ than $c_1$. Note that $m_1$ plus $m_2$ is m.

Then the partitioning and replacement by centroids is repeated over and over, until no significant improvement is found. Improvement is measured by comparing the distortion that results from using the pair of old testvectors as representatives of the training set to the distorting resulting from using the new pair. Specifically, the distortion from using a pair $c_1$, $c_2$ is (Equation 3)

$$\sum_{\substack{it\ x \text{ is closer} \\ \text{to } c_1 \text{ than } c_2}} \|x_i - c_1\|^2 + \sum_{\substack{it\ x \text{ is closer} \\ \text{to } c_1 \text{ than } c_2}} \|x_i - c_1\|^2$$

where $\|x\text{-}c\|$ denotes the Euclidean distance between the two vectors x and c.

Note that determining whether a testvector $x_i$ is closer to $c_1$ or $c_2$ is most quickly done by taking the dot product of $x_i$ with $(c_1-c_2)$ and comparing it to the threshold $(\|c_1\|^2-\|c_2\|^2)/2$.

After designing the two testvectors $c_1$ and $c_2$ at depth 1, the training set is split in half, with those training vectors that are closest to $c_1$ forming a training set associated with it and the rest forming a training set associated with $c_2$. For each of these two training sets, the above iterative binary splitting procedure is applied, obtaining the two children for $c_1$ and then the two children for $c_2$, with each child getting a subset of the original training vectors. This results in the four testvectors at depth 2. Applying the above iterative binary splitting procedure to these yields the testvectors at depth 3, and so on, until applying the iterative binary splitting to the training sets associated with the testvectors at depth d−1 yields the $2^d$ codevectors.

As described above, the TSVQ design procedure consists of performing the iterative binary splitting at each internal node. At any given node, in each iteration, a pair of centroids is calculated using Equations 1 and 2 and the resulting new distortion is calculated, each using Equation 3. These calculations occupy the major part of the TSVQ design program execution time. With our enhancements, the execution time for these calculations is reduced at least by 75%. These savings come by recognizing the $c'_2$ can be computed from $c'_1$ and the "parent" testvector c, whose children we seek, via $$c'_2 = \frac{1}{m - m_1}(mc - m_1c'_1)$$

where m is the number of training vectors associated with the parent node c.

Similar savings come by recognizing that the second term of Equation 3, denoted $D_2$, may be computed from the first term, denoted $D_1$, and the previously computed distortion associated with the parent node, denoted D, via $$D_2=D-D_1-m_1\|c_1-c\|^2-(m-m_1)\|c_2-c\|^2$$

These shortcuts enable the bypassing of many steps, and consequently save considerable execution time in designing the codebooks.

Another enhancement of our program involves sorting the training set. As discussed above, the program works by designing two testvectors at a time, working with the training set associated with their parent. This parent training set is a subset of the original large training set. And except for parents at very small depths, it is a small subset of the original training set, whose members are scattered widely through the original training set. Since the entire training set is too large to reside in fast computer memory, the bulk of it generally resides in a disk. When a training vector is needed for the above-mentioned calculations, it is not likely to be in fast memory. So the computer operating system brings it in from the disk. Although the operating systems also bring in a block of neighboring training vectors, the needed ones are scattered so widely, that no many are likely to be in the retrieved block. Therefore the operating system must make frequent, time-consuming disk accesses when executing just one iteration of the above process. To alleviate this problem, in our enhancement, whenever the design of two new testvectors has been completed, the training vectors associated with their parent are sorted so the training vectors associated with each child are stored contiguously. Thus, when one training vector is accessed, the operating system also retrieves a block of other needed training vectors. This greatly reduces the amount of time spent on disk accesses.

PHASE QUANTIZATION

A. Bit Allocation for Uniform Scalar Phase Quantizers

Turning now to the phase branch 36 (FIG. 2) a description of the phase processing will be given. In our experience, phase is very important in the low frequency range, but decreases in importance to where it becomes virtually unimportant at sufficiently high frequencies. From psychoacoustics studies, we have learned that the human ear cannot resolve time differences less than a certain threshold $\tau_o$. threshold can be converted into a tolerance on error for each phase term in the block. Let $f_S$ be the sampling frequency, let $f_i = i\, f_S/N$ be the frequency corresponding to the ith phase, where N is the number of samples in a block (1,024 in the presently preferred embodiment). Then the tolerable error in the ith phase is $$\delta\phi_i = 2\,\pi f_i \tau_o f_S/N \qquad \text{(Equation 4)}$$

It is seen from Equation 4 that when $\tau_o\, f_i = 1$, then $\delta\phi = 2\,\pi$. It is at this point that phase becomes unimportant and can be neglected. Let $f_o = 1/\tau_o$ be the frequency at which this holds. From psychoacoustic tables the parameter $\tau_o$ is found to be on the order of 100 $\mu$sec. Therefore, $f_o = 10$ kHz which corresponds to the 320th phase. Thus the phase from 320 to 512 are largely irrelevant.

As mentioned previously, the presently preferred embodiment uses uniform scalar quantization of the phase. Since adjacent phase values are uniformly distributed between 0 and $2\pi$ and since adjacent phases are uncorrelated, vector quantization would perform no better, but would be much more complex.

From Equation 4, more error in phase can be tolerated at higher frequencies than at low. From it, we determine that the step size of the uniform quantizer should vary with frequency. Specifically, the step size of the quantizer for the ith phase should be no larger than $\delta\phi_i$ as given in Equation 4. Thus the number of levels should be at least $2\pi/\delta\phi_i$ and the number of bits allocated to the quantizer should be the logarithm base 2 of the number of levels, rounded up to an integer. That is the number of bits $n_i$ to be allocated to the ith phase is $$n_i = \text{ceil}(\log_2[2\pi/\delta\phi_i]) \qquad \text{(Equation 5)}$$

where ceil(x) is the function returning the smallest integer no less than x. (A uniform scalar quantizer allocated n bits has $2^n$ levels, spaced apart by $2\pi/2^n$. Based on this principle, the bit allocations used in the preferred embodiment are shown in Table III. Note that to simplify the decoder, the bit allocations are the same for all phases in a band. Note also that the phases in band 12 are allocated 0 bits. This means that the decoder assumes they are zero, minus the pseudorandom phase dither described below. With these bit allocations, the indices for the uniform scalar phase quantizers require a total of 0.66 bits/sample.

TABLE III

Bit Allocations for the Uniform Scalar Phase Quantizers

| Band No. | Normal Bit Allocation | Augmented Bit Allocation |
|---|---|---|
| 1 | 10 | 10 |
| 2 | 8 | 8 |
| 3 | 6 | 6 |
| 4 | 5 | 5 |
| 5 | 4 | 4 |
| 6 | 3 | 3 |
| 7 | 3 | 3 |
| 8 | 2 | 2 |
| 9 | 2 | 2 |
| 10 | 1 | 2 |
| 11 | 1 | 2 |
| 12 | 0 | 0 |

B. Pseudorandom Phase Dither

If the first quantization level of each of the uniform scalar quantizers described above represents the same phase value, say phase 0, then the quantization errors introduced by the various quantizers will be highly correlated and such correlated errors will be distinctly audible. The audibility of said errors is due to the fact that the effect of the inverse transform operating on the quantized magnitudes and phases is to produce sinusoids at the various frequencies with related phases. However, these phase relationship are abruptly interrupted at block boundaries, and this can be heard as a crackling noise. The audible effects of this phenomenon can be eliminated by pseudorandomly staggering the first levels of the uniform scalar quantizers.

In the preferred embodiment, each uniform quantizer is designed in some arbitrary way, and the necessary staggering is assured by adding pseudorandom dither before quantizing, and by subtracting the pseudorandom dither when decoding. Specifically, a pseudorandom sequence of phases $\Psi_1, \Psi_2, \ldots, \Psi_{512}$, with one term for each phase and with each term between 0 and $2\pi$, is stored at both the encoder and the decoder. Before quantizing the ith phase $\phi_i$, the term $\Psi_i$ is added to it, the sum is quantized and an index is produced. At the decoder, $\Psi_i$ is subtracted from the phase value corresponding to the index. We have found that this approach satisfactorily eliminates the audibility of these phase errors. Note that a phase coefficient $\phi_i$ corresponding to a large frequency that is allocated zero bits in Table III is not actually quantized. Rather the decoder merely reproduces it as $-\Psi_i$.

C. Dynamic Augmentation of Phase Bit Allocations

As previously stated, a greater number of bits are allocated to the phase quantizers in blocks containing transients such as drumbeats. And as described earlier, the purpose of this augmented bit allocation is to reduce the pre-echo. Increasing the bit allocations of the phase quantizers in a block containing a transient reduces the overall quantization error, thereby reducing the errors that may be spread to the quiet initial segment. If allowed to happen, such errors would be heard as pre-echo. Since it is the high frequency phases that are given the smallest bit allocations (see Table III), it is these phases that are the source of the most quantization errors, and it is these phases whose quantizers need to have their rates augmented. The method for detecting frames was described earlier, and as stated there, the effect of said method is to set a flag indicating whether the frame contains a transient. If so, the bit allocations for the phase quantizers are increased. The augmented phase allocations to be used in this case are shown in Table III. For example, in band 10 the bit allocations for the phases are increased from 1 to 2 bits; i.e., they have 4 rather than 2 levels. Among all segments encoded to date, no more than 1/6 of the blocks all required augmented bit allocations. Correspondingly, no more than 0.028 bits per sample has been needed for the augmentation.

SUMMARY OF THE ENCODING

Figure 4A:
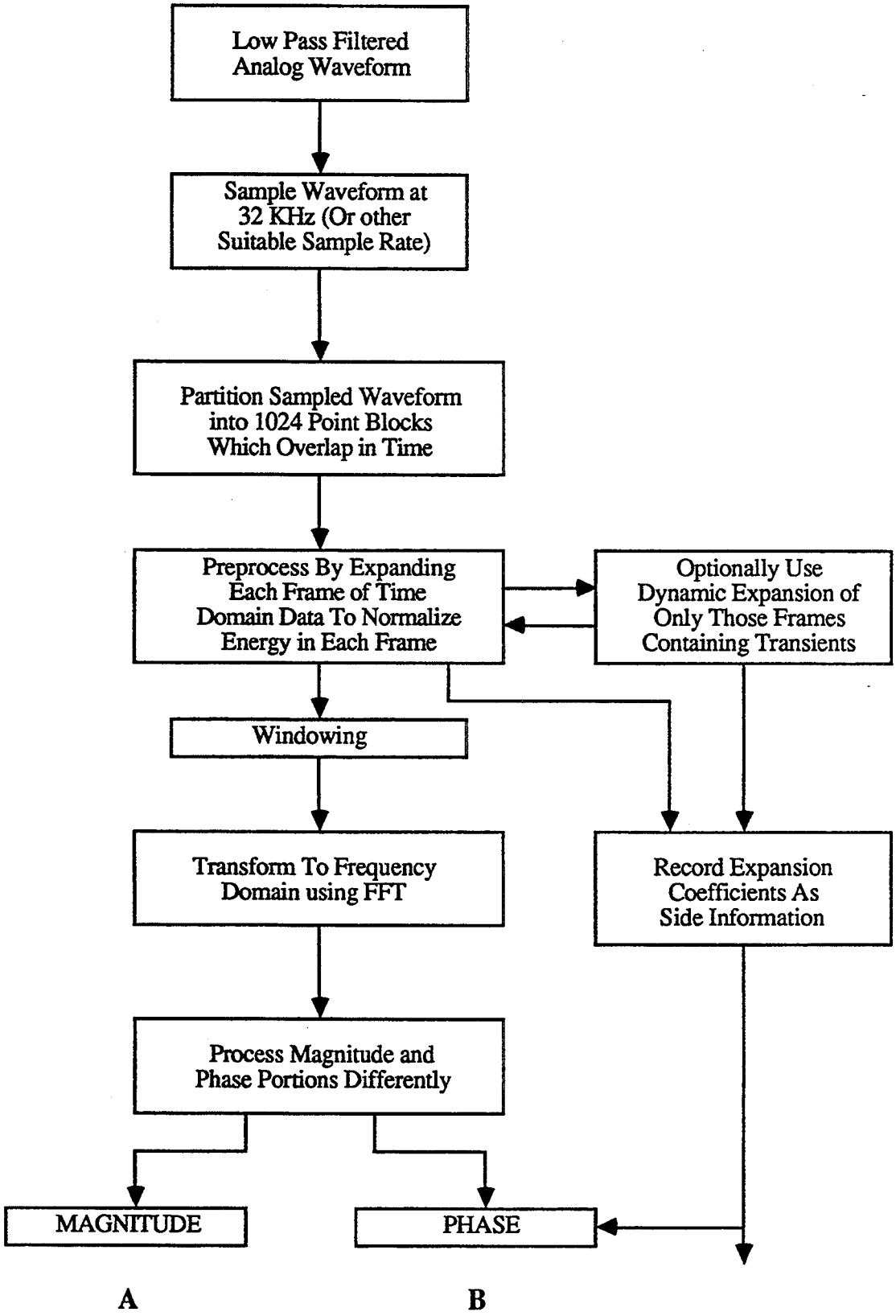
FIGS. 4*a* and 4*b* are flow diagrams of the encoding process.
Figure 4B:
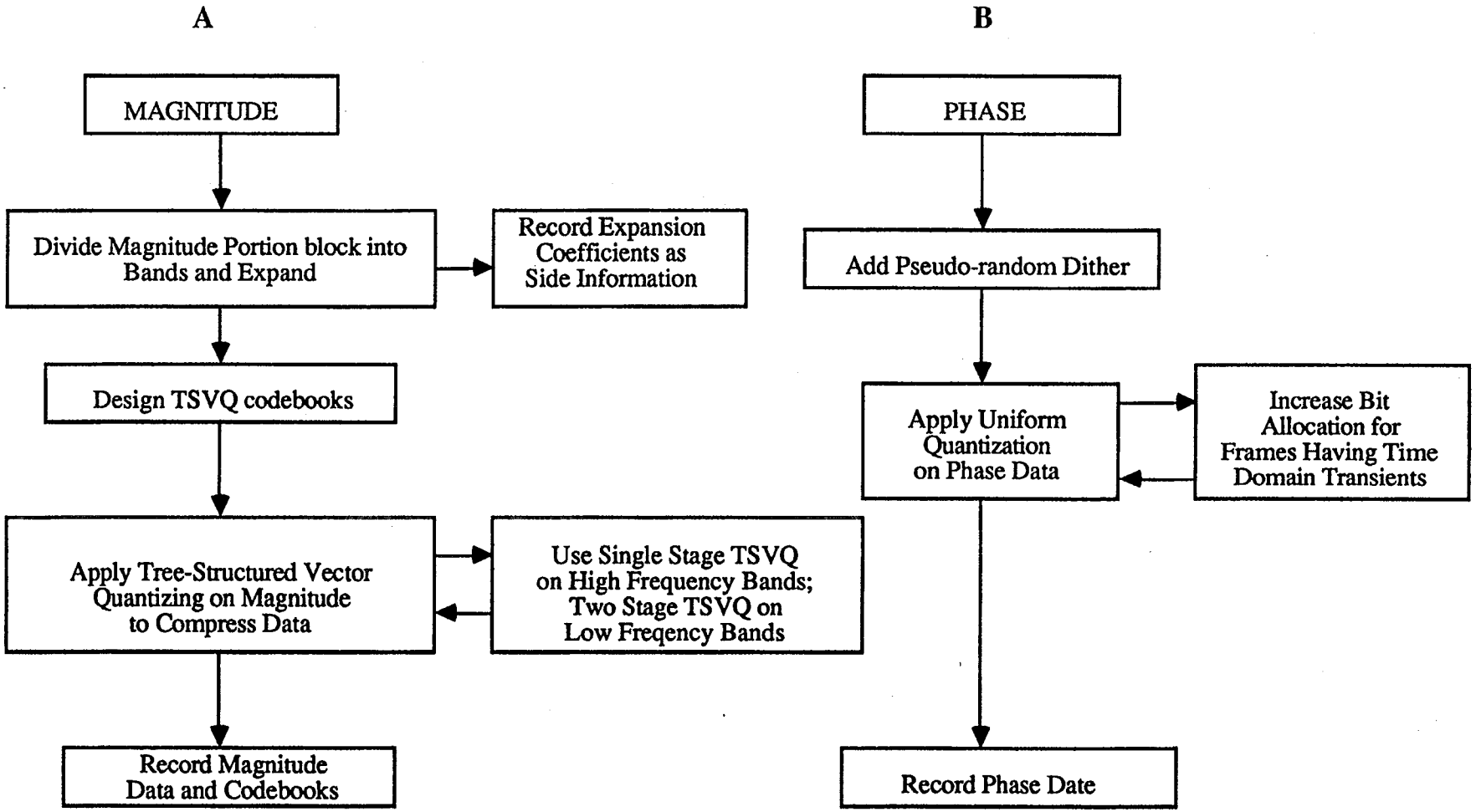

Turning now to FIGS. 4*a* and 4*b*, the encoding process is summarized. As previously explained, the magnitude and phase portions are treated differently. Accordingly, the flow diagram of FIG. 4*a* shows a magnitude path A and a phase path B which correspond to the magnitude branch A and phase branch B of FIG. 4*b*.

With the presently preferred embodiment, the encoded digital data includes bits representing the dynamic time expansion parameters (at most 0.002 bits/sample), the time domain expansion factors (0.004 bits/sample), the DC magnitude coefficient (0.017 bits/sample), the band-by-band expansion factors (0.05 bits/sample), the magnitude vector quantization codebooks (0.031 bits/sample), magnitude vector quantizer indices (0.96 bits/sample), the baseline phase quantizer indices (0.66 bits/sample), and the augmented bits for the phase quantizers (at most 0.028 bits/sample) for a total of at most 1.75 bits/sample. With the 32,000 samples/sec sampling rate, this induces 56,000 bits/second, or 0.42 megabytes/minute However, it is possible to change the parameters of the quantizers (for example to increase or decrease the allocations to the magnitude and phase quantizers) to achieve other rate or quality goals.

DECODING

Figure 5:
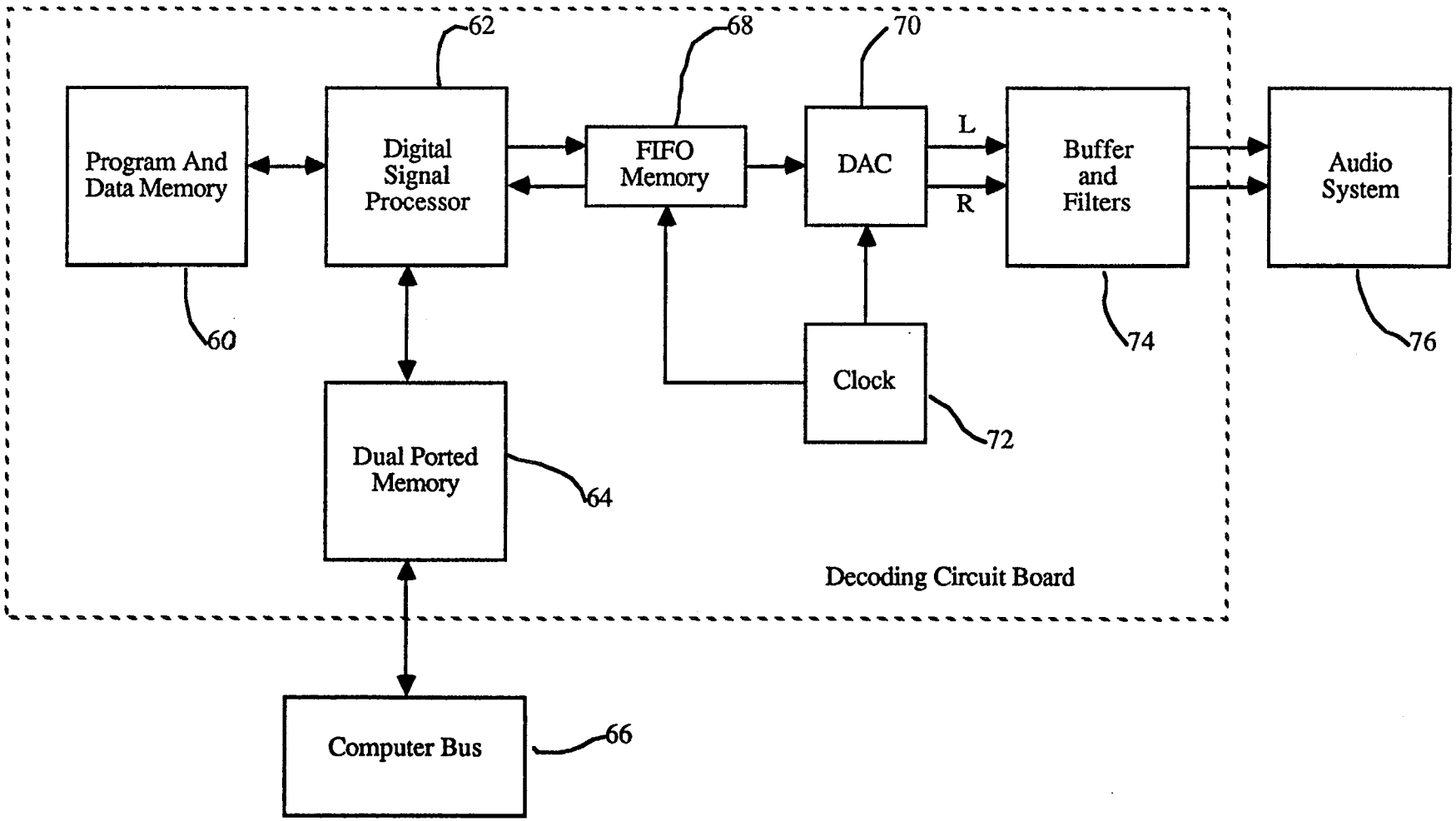
FIG. 5 is a schematic diagram of the presently preferred decoding system.

The decoding process, as stated earlier, is essentially the complement of the encoding process. FIG. 5 depicts the presently preferred decoding circuit, which simultaneously decodes left and right channels of a segment for which both channels have been encoded using the method previously described. This decoding circuit will now be described. Referring to FIG. 5, the decoding circuit comprises random access program and data memory 60, a digital signal processor chip 62 which may be one of several available. The digital signal processor is coupled through a block of dual-ported memory 64 to the computer bus 66 of a computer system which controls the local storage medium on which the compressed data has been stored. A first in, first out (FIFO) memory block 68 communicates with signal processor 62 to transfer the decoded, decompressed data to the digital-to-analog convertor (DAC) 70. The digital-to-analog convertor as well as the FIFO memory 68 are synchronized by clock 72. The digital-to-analog convertor provides stereo outputs L and R which are applied to a buffer and filter circuit 74. The output of circuit 74 feeds the conventional analog audio system 76.

At the start of playback of a segment, the magnitude vector quantization codebooks for the individual subbands are moved from the hard disk of the main computer via the computer bus 66 and dual-ported memory 64 to the signal processor 62. The codebooks are stored in the program and data memory 60. Block by block, the encoded digital data consisting of indices and side information, such as scale factors and flag bits, are moved from the hard disk to buffers, in the main computer memory and then to the dual-ported memory in synchronism with signal processor use.

Using the signal processor 62, the magnitude indices are used to retrieve vector quantizer codewords forming a rendition of the magnitude block. The individual bands are then scaled by the inverse band-by-band expansion factors.

Similarly, the phase quantizer indices are used to create a rendition of the phase block, from which the pseudorandom dither sequence is subtracted. (If the transient flag is set, the indices are decoded with the augmented quantizers.)

The completed magnitude and phase blocks are converted to real and imaginary representation. This block is then inverse Fourier transformed using an inverse FFT program on the DSP to produce a rendition of the time domain block. The preferred implementation uses one inverse FFT to simultaneously inverse transform a left and right block. Specifically, let $L_r$ and $R_r$ denote the real parts of the frequency domain blocks of the left and right channels, respectively, and let $L_i$ and $R_i$ denote the imaginary parts of the frequency domain blocks of the left and right channels, respectively. Then applying the inverse FFT to the complex valued block whose real part is $L_r-R_r$ and whose imaginary part is $L_i+R_r$ yields a complex time domain block whose real part is the rendition of the left time domain block and whose imaginary part is the rendition of the right time domain block.

These time domain blocks are windowed, just as in the decoder, and the overlapping portions are added.

The time domain blocks are then scaled according to the inverses of the time domain expansion factors.

If the transient flag is set, the subblocks of the blocks are scaled according to the dynamic time domain expansion parameters.

Finally, the blocks are moved to the FIFO. On demand from the master clock 72 the data are moved to the digital-to-analog convertor 70 in serial. The analog information is presented to buffers and filters 74 and thence to the power amplifiers and speakers of the audio system 76.

The decoding circuitry can be implemented on a single circuit board suitable for plugging into the backplane of a host computer. Thus, the invention on the playback side can be implemented with a comparatively inexpensive microcomputer or personal computer having hard disk storage sufficient to hold the compressed data of the program material. The playback system operates in real time using comparatively inexpensive components. Thus the invention can be used as a substitution for the mechanically complex jukebox changers now in use. In contrast with conventional mechanical jukeboxes, the only moving parts on the playback side employing the invention are the computer system power supply fan and hermetically sealed hard disk drive. Both of these components are highly reliable and easily replaced if damaged. Thus the resulting digital jukebox can be virtually maintenance free. Moreover, since there are no records or discs to become scratched or damaged during installation and use, a considerable cost savings is achieved.

While the invention has been described in connection with a presently preferred embodiment suitable for jukebox music distribution, the invention is not limited to this application and may be modified without departing from the spirit of the invention as set forth in the appended claims.

What is claimed is:

1. A method of processing a wideband digital audio signal and for storing the processed signal on a data storage medium comprising:

dividing said wideband digital audio signal into signal blocks each block having a maximum signal value;

scaling each signal block by a constant value selected such that the maximum absolute signal value in each block equals a predetermined value within a preset range and setting a scale factor equal to said constant value for each signal block;

transforming each said signal block into transform blocks comprising a plurality of transform values representative of the audio signal in its associated signal block;

quantizing said transform blocks; and recording said quantized transform blocks and said scale factors as digital data on the data storage medium.

2. The method of claim 1 wherein said digital audio signal is divided into overlapping signal blocks.

3. The method of claim 1 wherein said digital audio signal is divided into non-overlapping signal blocks.

4. The method of claim 1 further comprising reproducing said quantized transform blocks from said recorded digital data;

inverse transforming and inverse scaling said quantized transform blocks into decoded signal blocks; and recombining said decoded signal blocks into a reproduction of said wideband digital audio signal.

5. The method of claim 4 wherein said decoded signal blocks are represented by a predetermined arithmetic precision and wherein said predetermined value of said scaling step is selected based upon said arithmetic precision.

6. A method of processing a wideband digital audio signal and for storing the processed signal on a data storage medium comprising:

dividing said wideband digital audio signal into signal blocks;

dividing said signal blocks into a plurality of subblocks;

detecting transients in said subblocks and setting a transient flag associated with said signal block to a predetermined value if a transient greater than a predetermined threshold is detected;

if the transient flag is set to said predetermined value, scaling each subblock in accordance with transients detected to produce processed signal blocks and generating a scale factor for each subblock;

said scaling step further comprising the step of scaling at least one subblock occurring a predetermined time before a detected transient differently than scaling the subblock containing the transient;

transforming said processed signal blocks into transform blocks each comprising a plurality of transform values representative of the audio signal in its associated block;

quantizing said transform blocks; and recording said quantized transform blocks, transient flags and scale factors as digital data on the data storage medium.

7. The method of claim 6 wherein stepwise scaling is used to scale said adjacent subblocks to effect a transition from the scaling applied to the pre-transient subblocks to the scaling applied to the subblock containing the detected transient.

8. The method of claim 6 wherein said digital audio signal is divided into overlapping signal blocks.

9. The method of claim 6 wherein said digital audio signal is divided into non-overlapping signal blocks.

10. The method of claim 6 further comprising reproducing said quantized transform blocks from said recorded digital data;

inverse transforming and inverse scaling said quantized transform blocks into decoded signal blocks; and recombining said decoded signal blocks into a reproduction of said wideband digital audio signal.

11. A method of processing a wideband digital audio signal and for storing the processed signal on a data storage medium comprising;

dividing said wideband digital audio signal into signal blocks;

detecting if a transient occurs in each signal block and setting a transient flag to a predetermined value when a transient is detected;

when said transient flag equals said predetermined value, dividing said signal blocks into a plurality of subblocks;

scaling each subblock in accordance with transients detected to produce processed signal blocks and generating a scale factor for each subblock;

said scaling step further comprising the step of scaling at least one subblock occurring a predetermined time before a detected transient differently than scaling the subblock containing the transient;

transforming said processed signal blocks into transform blocks each comprising a plurality of transform values representative of the magnitude and phase of the audio signal as a function of frequency in its associated block;

quantizing said transform blocks; and recording said quantized transform blocks, transient flags and scale factors as digital data on a data storage medium.

12. A method of processing a wideband digital audio signal and for storing the processed signal on a dam storage medium comprising;

dividing said wideband digital audio signal into signal blocks;

Fourier transforming said signal blocks into transformed blocks representative of the magnitude and phase of the audio signal in its associated block as a function of frequency;

extracting from said transformed blocks magnitude data blocks and phase data blocks as a function of frequency;

grouping said magnitude data blocks and phase data blocks into a plurality of adjacent frequency bands, said frequency bands extending from low frequency bands to high frequency bands;

applying a first quantization process upon said magnitude data blocks in each frequency band to develop quantized magnitude blocks;

applying a second quantization process upon said phase dam blocks in each frequency band to develop quantized phase blocks, said second quantization process developing higher precision quantization in said low frequency bands than in said high frequency bands;

recording said quantized magnitude blocks and said quantized phase blocks as digital data on the data storage medium wherein said first quantization process includes two-stage vector quantization of said magnitude data blocks.

13. The method of claim 12 wherein said digital audio signal is divided into overlapping signal blocks.

14. The method of claim 12 wherein said digital audio signal is divided into non-overlapping signal blocks.

15. The method of claim 12 further comprising reproducing said quantized transform blocks from said recorded digital data;

inverse transforming and inverse scaling said quantized transform blocks into decoded signal blocks; and recombining said decoded signal blocks into a reproduction of said wideband digital audio signal.

16. The method of claim 12 wherein said first quantization process includes vector quantizing said magnitude data blocks.

17. The method of claim 12 wherein said first quantization process includes tree-structured vector quantization of said magnitude data blocks.

18. The method of claim 12 wherein said second quantization process includes quantization where the quantizer is designed so that quantization error in any phase data term is inversely proportional to the frequency of said term.

19. The method of claim 12 wherein said second quantization process includes scalar quantization with level spacing chosen so that the error resulting from said quantization does not exceed a value inversely proportional to the frequency of said term.

20. The method of claim 12 wherein said second quantization process includes scalar quantization with pseudorandom dither added to the phases.

21. The method of claim 12 wherein said second quantization process includes the step of dynamically altering bit allocation based in the wideband digital audio signal.

22. A method of processing a wideband digital audio signal and for storing the processed signal in a data storage medium comprising the steps of:

dividing said wideband audio signal into signal blocks,

Fourier transforming each said block into transform blocks representative of the magnitude and phase of the audio signal as a function of frequency in its associated block, grouping said transform blocks into a plurality of adjacent frequency bands, each frequency band having a predetermined magnitude quantizer factor and predetermined phase quantizer factors, said quantizer factors determining the degree of precision of a subsequent quantization, quantizing the magnitudes and phases of each transform block in each frequency band in accordance with its respective quantizer factor to develop quantized magnitude blocks and quantized phase blocks, and recording said quantized magnitude blocks and quantized phase blocks as digital data on the data storage medium.

23. The invention as defined in claim 22 wherein the precision of the phase quantizer factor increases from the higher frequency bands to the lower frequency bands.

24. The invention as defined in claim 22 and comprising the step of introducing a random dither to phase quantizing step at least one of said frequency bands.

25. A method of processing a wideband digital audio signal and for storing the processed signal on a data storage medium comprising:

dividing said wideband digital audio signal into signal blocks;

dividing said signal blocks into a plurality of subblocks;

detecting transients in said subblocks and setting a transient flag associated with said signal block to a predetermined value if a transient greater than a predetermined threshold is detected;

if the transient flag is set to said predetermined value, scaling each subblock in accordance with transients detected to produce processed signal blocks and generating a scale factor for each subblock;

said scaling step further comprising the step of scaling at least one subblock occurring a predetermined time after a detected transient differently than scaling the subblock containing the transient;

transforming said processed signal blocks into transform blocks each comprising a plurality of transform values representative of the audio signal in its associated block;

quantizing said transform blocks; and recording said quantized transform blocks, transient flags and scale factors as digital data on the data storage medium.

26. A method of processing a wideband digital audio signal and for storing the processed signal on a data storage medium comprising;

dividing said wideband digital audio signal into signal blocks;

detecting if a transient occurs in each signal block and setting a transient flag to a predetermined value when a transient is detected;

when said transient flag equals said predetermined value, dividing said signal blocks into a plurality of subblocks;

scaling each subblock in accordance with transients detected to produce processed signal blocks and generating a scale factor for each subblock;

said scaling step further comprising the step of scaling at least one subblock occurring a predetermined time after a detected transient differently than scaling the subblock containing the transient;

transforming said processed signal blocks into transform blocks each comprising a plurality of transform values representative of the magnitude and phase of the audio signal as a function of frequency in its associated block;

quantizing said transform blocks; and recording said quantized transform blocks, transient flags and scale factors as digital data on a data storage medium.

27. A method of processing a wideband digital audio signal and for storing the processed signal on a data storage medium comprising:

dividing said wideband digital audio signal into signal blocks;

Fourier transforming said signal blocks into transformed blocks representative of the magnitude and phase of the audio signal in its associated block as a function of frequency;

extracting from said transformed blocks magnitude data blocks and phase data blocks as a function of frequency;

grouping said magnitude data blocks and phase data blocks into a plurality of adjacent frequency bands, said frequency bands extending from low frequency bands to high frequency bands;

applying a first quantization process upon said magnitude data blocks in each frequency band to develop quantized magnitude blocks;

applying a second quantization process upon said phase data blocks in each frequency band to develop quantized phase blocks, said second quantization process developing higher precision quantization in said low frequency bands than in said high frequency bands;

recording said quantized magnitude blocks and said quantized phase blocks as digital data on the data storage medium wherein said first quantization process includes tree-structured vector quantization of said magnitude data blocks.

28. The method of claim 27 further comprising reproducing said quantized transform blocks from said recorded digital data;

inverse transforming and inverse scaling said quantized transform blocks into decoded signal blocks; and recombining said decoded signal blocks into a reproduction of said wideband digital audio signal.

29. A method of processing a wideband digital audio signal and for storing the processed signal on a data storage medium comprising:

dividing said wideband digital audio signal into signal blocks;

Fourier transforming said signal blocks representative of the magnitude and phase of the audio signal in its associated block as a function of frequency;

extracting from said transformed blocks magnitude data blocks and phase data blocks as a function of frequency;

grouping said magnitude data blocks and phase data blocks into a plurality of adjacent frequency bands, said frequency bands extending from low frequency bands to high frequency bands;

applying a first quantization process upon said magnitude data blocks in each frequency band to develop quantized magnitude blocks;

applying a second quantization process upon said phase data blocks in each frequency band to develop quantized phase blocks, said second quantization process developing higher precision quantization in said low frequency bands than in said high frequency bands;

recording said quantized magnitude blocks and said quantized phase blocks as digital data on the data storage medium wherein each phase data block comprises a plurality of phase coefficients and wherein said second quantization process comprises the step of applying a scalar quantizer to each phase coefficient with a level spacing inversely proportional to the frequency of each coefficient.

30. A method of processing a wideband digital audio signal and for storing the processed signal on a data storage medium comprising:

dividing said wideband digital audio signal into signal blocks;

Fourier transforming said signal blocks into transformed block representative of the magnitude and phase of the audio signal in its associated block as a function of frequency;

extracting from said transformed blocks magnitude data blocks and phase data blocks as a function of frequency;

grouping said magnitude data blocks and phase data blocks into a plurality of adjacent frequency bands, said frequency banks extending from low frequency bands to high frequency bands;

applying a first quantization process upon said magnitude data blocks in each frequency band to develop quantized magnitude blocks;

applying a second quantization process upon said phase data blocks in each frequency band to develop quantized phase blocks, said second quantization process developing higher precision quantization in said low frequency bands than in said high frequency bands;

recording said quantized magnitude blocks and said quantized phase blocks as digital data on the data storage medium;

detecting a transient in said transformed blocks and, when detected, decreasing the level spacing with respect to said second quantization process.

31. The method of claim 30 further comprising reproducing said quantized transform blocks from said recorded digital data;

inverse transforming and inverse scaling said quantized transform blocks into decoded signal blocks; and recombining said decoded signal blocks into a reproduction of said wideband digital audio signal.

32. A method of processing a wideband digital audio signal and for storing the processed signal on a data storage medium comprising;

dividing said wideband digital audio signal into signal blocks;

Fourier transforming said signal blocks into transformed blocks representative of the magnitude and phase of the audio signal in its associated block as a function of frequency;

extracting from said transformed blocks magnitude data blocks and phase data blocks as a function of frequency;

grouping said magnitude data blocks and phase data blocks into a plurality of adjacent frequency bands, said frequency bands extending from low frequency bands to high frequency bands;

scaling each said frequency band by a constant value selected such that the energy of the frequency band equals a predetermined value within a preset range;

applying a first quantization process upon said magnitude data blocks in each frequency band to develop quantized magnitude blocks;

applying a second quantization process upon said phase data blocks in each frequency band to develop quantized phase blocks, said second quantization process developing higher precision quantization in said low frequency bands than in said high frequency bands;

recording said quantized magnitude blocks said constant values and said quantized phase blocks as digital data on the data storage medium wherein said first quantization process includes two-stage vector quantization of said magnitude data blocks.

33. The method of claim 32 further comprising reproducing said quantized transform blocks from said recorded digital data;

inverse transforming and inverse scaling said quantized transform blocks into decoded signal blocks; and recombining said decoded signal blocks into a reproduction of said wideband digital audio signal.

* * * * *

UNITED STATES PATENT AND TRADEMARK OFFICE

CERTIFICATE OF CORRECTION

PATENT NO. : 5,388,181

DATED : February 7, 1995

INVENTOR(S) : David J. Anderson et al

It is certified that error appears in the above-indentified patent and that said Letters Patent is hereby corrected as shown below:

Column 8, line 7, after "quantizer" insert --40.--.

Column 15, line 4, before "threshold" (second occurrence), insert --This--.

Column 18, line 11, delete "$L_r-R_r$" and insert --$L_r-R_i$--.

Column 21, line 55, after "step", insert --at--.

Signed and Sealed this

Sixth Day of June, 1995

Bruce Lehman

*Attest:*

BRUCE LEHMAN

*Attesting Officer*

*Commissioner of Patents and Trademarks*